US007089876B2

(12) United States Patent
Porat

(10) Patent No.: US 7,089,876 B2
(45) Date of Patent: Aug. 15, 2006

(54) FLOATING ELECTRONIC PLATFORM FOR SWIMMING POOLS AND SPAS

(75) Inventor: Joseph Porat, North Caldwell, NJ (US)

(73) Assignee: Aquatron LLC, Cedar Grove, NJ (US)

( * ) Notice: Subject to any disclaimer, the term of this patent is extended or adjusted under 35 U.S.C. 154(b) by 0 days.

(21) Appl. No.: 10/292,793

(22) Filed: Nov. 12, 2002

(65) Prior Publication Data

US 2004/0092181 A1 May 13, 2004

(51) Int. Cl.
*B63B 59/00* (2006.01)

(52) U.S. Cl. ..... 114/222; 441/1

(58) Field of Classification Search ..... 441/1, 441/6; 114/222

See application file for complete search history.

(56) References Cited

U.S. PATENT DOCUMENTS 2,452,922 A * 11/1948 Gonsett et al. ..... 174/67
3,550,714 A * 12/1970 Bellinger ..... 180/168
3,916,122 A * 10/1975 Sato et al. ..... 369/7
4,503,563 A * 3/1985 Johnson ..... 455/351
4,523,913 A * 6/1985 Kaino ..... 441/81
4,553,194 A * 11/1985 Bailey ..... 362/267
5,066,256 A * 11/1991 Ward, Sr. ..... 441/7
5,228,998 A * 7/1993 DiClemente et al. ..... 210/610
5,234,144 A * 8/1993 Iler ..... 224/191
5,369,796 A * 11/1994 Kung ..... 455/344
6,014,833 A * 1/2000 Benavidez ..... 43/54.1
6,448,494 B1 * 9/2002 Erlich et al. ..... 174/46
6,525,762 B1 * 2/2003 Mileski et al. ..... 348/81

* cited by examiner

*Primary Examiner*—Stephen Avila
(74) *Attorney, Agent, or Firm*—Abelman, Frayne & Schwab

(57) ABSTRACT

A stable, manually portable floating electronic platform for use in pools and spas is equipped with recesses for receiving beverage containers and is equipped with any of a variety of electronic audio/visual entertainment devices that are powered by an on-board battery, or a remote rechargeable battery or a conventional remote low-voltage power supply unit via a power cable. Solar power collector panels on the platform provide a recharging current to on-board or remote batteries via a power cable.

20 Claims, 4 Drawing Sheets

FIG. 6
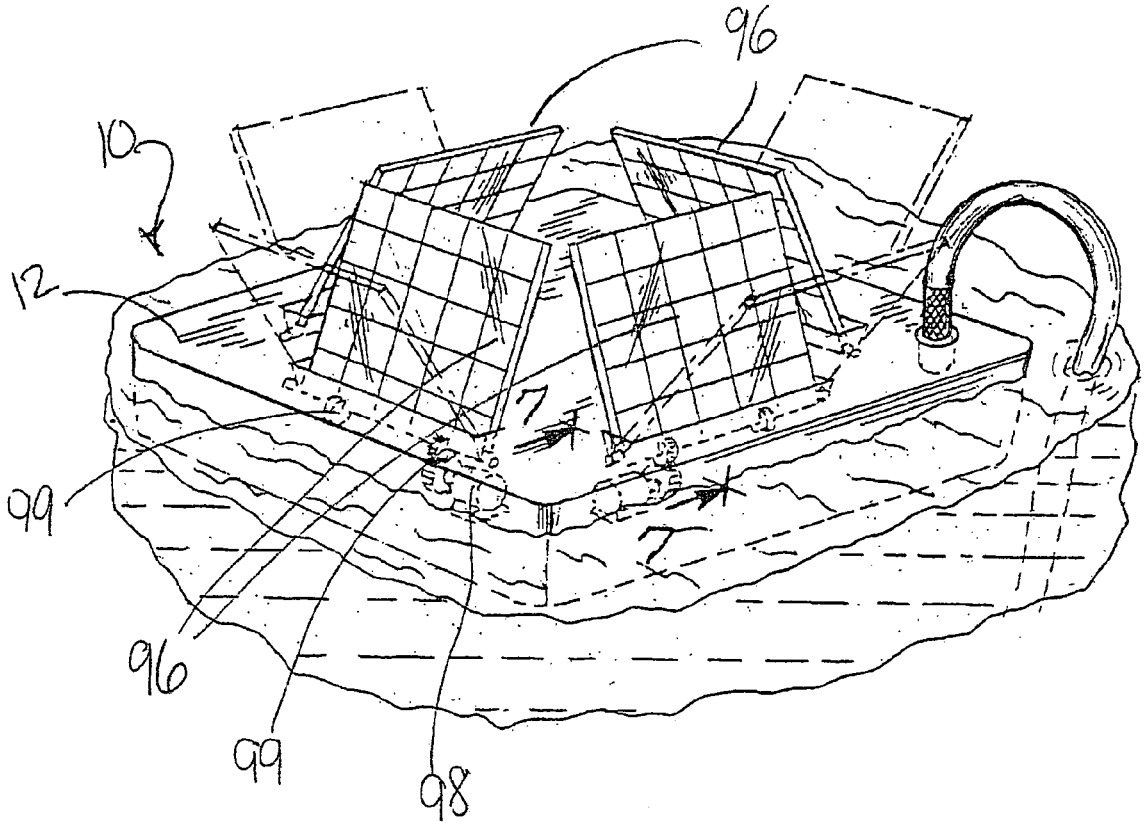
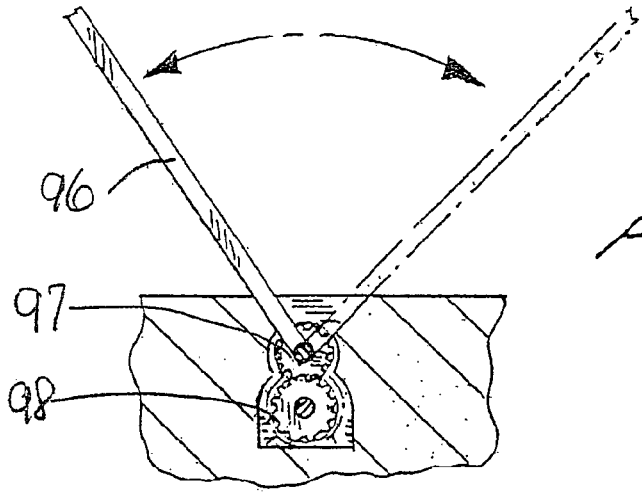
FIG. 7

FLOATING ELECTRONIC PLATFORM FOR SWIMMING POOLS AND SPAS

FIELD OF THE INVENTION

This invention relates to floating swimming pool accessories used to support and retain beverage containers and the like.

BACKGROUND OF THE INVENTION

Various floating accessories have been developed for use in swimming pools to accommodate beverage cups, containers, sunglasses, suntanning preparation containers and other small items utilized by bathers. For example, cup holders have been attached to floating chairs and lounge mats and to pool skimmers and similar floating filter devices.

Portable radios, with and without ear plugs have also been developed for use by bathers. However, due to their small size and limited battery power and capacity, these small portable radios of the prior art have a limited audible range and are generally limited to personal use.

It is therefore an object of the present invention to provide a floating platform or entertainment center that maintains and stores beverage containers, cups and other personal items and that also includes a power source sufficient to power a radio, tape or CD player having one or more speakers that are capable of broadcasting audible signals to users in, and around the pool.

It is a further object of the invention to provide a floating electronic entertainment station that can be powered by on-board batteries, by a cable attached to a relatively low-voltage power supply, e.g., 12-volts, outside of the pool; or by a power cable extending from a robotic pool cleaner which cleaner is either battery-powered or receives its power from outside the pool via another separate cable.

It is yet another object of the invention to provide a floating electronic platform equipped with solar collectors that are attached to one or more rechargeable batteries that are located on-board the floating platform or in a remote battery-powered robotic pool cleaner.

In yet another preferred embodiment, a floating electronic platform that supports one or more solar energy collection panels and a battery or battery pack provides the electrical power via a power cable attached to a robotic pool cleaner. In this embodiment, the robotic pool cleaner has no battery of its own, and is therefore considerably lighter in weight and easier to remove and transport outside of the pool than a comparable model having its own internal rechargeable batteries. Pool cleaners of the prior art that receive their electrical power from a remote, pool-side power source can be utilized in this embodiment. Since the power cable extending between the pool cleaner and the floating electronic platform can a positive buoyancy, the tethering of the platform on the surface will not impede the patterns of movement of the submerged pool cleaner during its operation.

SUMMARY OF THE INVENTION

The above objects and other advantages are obtained by a buoyant article of manufacture that is provided with one or more recesses for receiving any one or more of a variety of articles, such as cups, beverage containers and various other small items customarily used by bathers; electronic devices such as a cordless telephone, television, a radio, tape and/or CD player with speakers and having the capacity to produce a signal that is audible to bathers and others alongside who are in the vicinity of the pool or spa; one or more solar power collection panels; and a power source. As used herein, the term "power source" is intended to include one or more on-board batteries, a power cable extending from the floating platform and having means for connection to an external source of power, such as a remote battery or other DC plug/receptacle; and a power input jack or plug mounted in the housing of the floating platform for attachably receiving a power cable connected to an external power source.

In a particularly preferred embodiment, the floating platform is fabricated from impact-resistant molded plastic having an appealing ornamental design, shape and color scheme that has aesthetic appeal. The materials of construction should be resistant to UV from exposure to the sun and to the chemicals customarily used to treat pool or spa water.

The external appearance and configuration can assume that of a boat, ship, a marine creature, a space ship, or any other configuration within the imagination of commercial and industrial designers and the artists. The floating electronic platform is provided with ballast as required to render it stable under the conditions that can be anticipated for use in a swimming pool or spa. Other design features, including the size of recesses to hold beverage containers, cups, coffee mugs, electric devices, and the like will be readily apparent to one of ordinary skill in the art. As used herein, electronic devices is intended to include audio entertainment systems, such as radios, tape and/or CD players; televisions and DVD players; and solar power collector panels.

In a preferred embodiment, the sound system, which includes one or more speakers and the radio, tape and/or CD player, are contained in a waterproof compartment with manually operable external control elements that are entirely waterproof and that can withstand at least a brief emersion in the event that the article is capsized, splashed with water or temporarily submerged when being place in, or removed from the pool or spa. The electronic devices, such as a cordless telephone can be removable from waterproof compartments for maintenance or replacement. Compartment access closures can be provided with gaskets, o-rings and other seals well known in the art. The closures can be secured by screws and/or manually releasable fasteners.

The floating entertainment platform can be equipped with illumination sources, such as LEDs to create a decorative effect on the pool surface. A water pump and one or more fountain jets can be fitted to the housing body to produce water sprays.

In a further preferred embodiment, the floating article includes at least one, but preferably two handles. The handles are used when the platform is removed from the water and transported, e.g., for storage.

In one preferred embodiment, the floating entertainment station includes a water-tight battery storage compartment that is accessed through a hinged door located on the bottom or a side wall. When the battery is located in a lower compartmentalized portion of the floating station it serves as ballast and provides stability to the unit.

In a particularly preferred embodiment, a portion of the upper exposed surface of the floating station includes one or more solar panels, the panels preferably being positioned to receive a protective cover to avoid risk of damage from water toys and sports activities, and when the unit is removed for storage.

The external surface of the platform is preferably provided with one or more plugs and/or jacks that function as power input and output connections. These exterior connections can be used to attach cables from the floating platform to a battery-powered robotic cleaner that is submerged in the pool. In the embodiment that includes solar power collection panels, recharging of the batteries in both the floating platform and submerged pool cleaner can be accomplished, either simultaneously or consecutively by providing appropriate circuity know in the art. As an alternative to a plurality of inlet and outlet receptacles, an external multiple position switch can be utilized.

The output leads of the solar collector panels are connected to a plug and/or jack adapted to receive a charging cable that is connected to a rechargeable battery. If the floating station has its own on-board battery, the solar panel leads can be attached to terminals with further leads to the battery pack. The on-board battery can be connected via a power cable to a submerged robotic pool cleaner in the pool to serve as a tethered source of power for the pool cleaner during its operation.

BRIEF DESCRIPTION OF THE DRAWINGS

The invention will be described in further detail below and with reference to the attached drawing sheets in which:

FIG. 6 is a top side perspective view of another embodiment of a floating electronic platform of the invention; and FIG. 7 is a partial sectional view taken along line 7—7 of FIG. 6

DETAILED DESCRIPTION OF THE PREFERRED EMBODIMENTS

Figure 1:
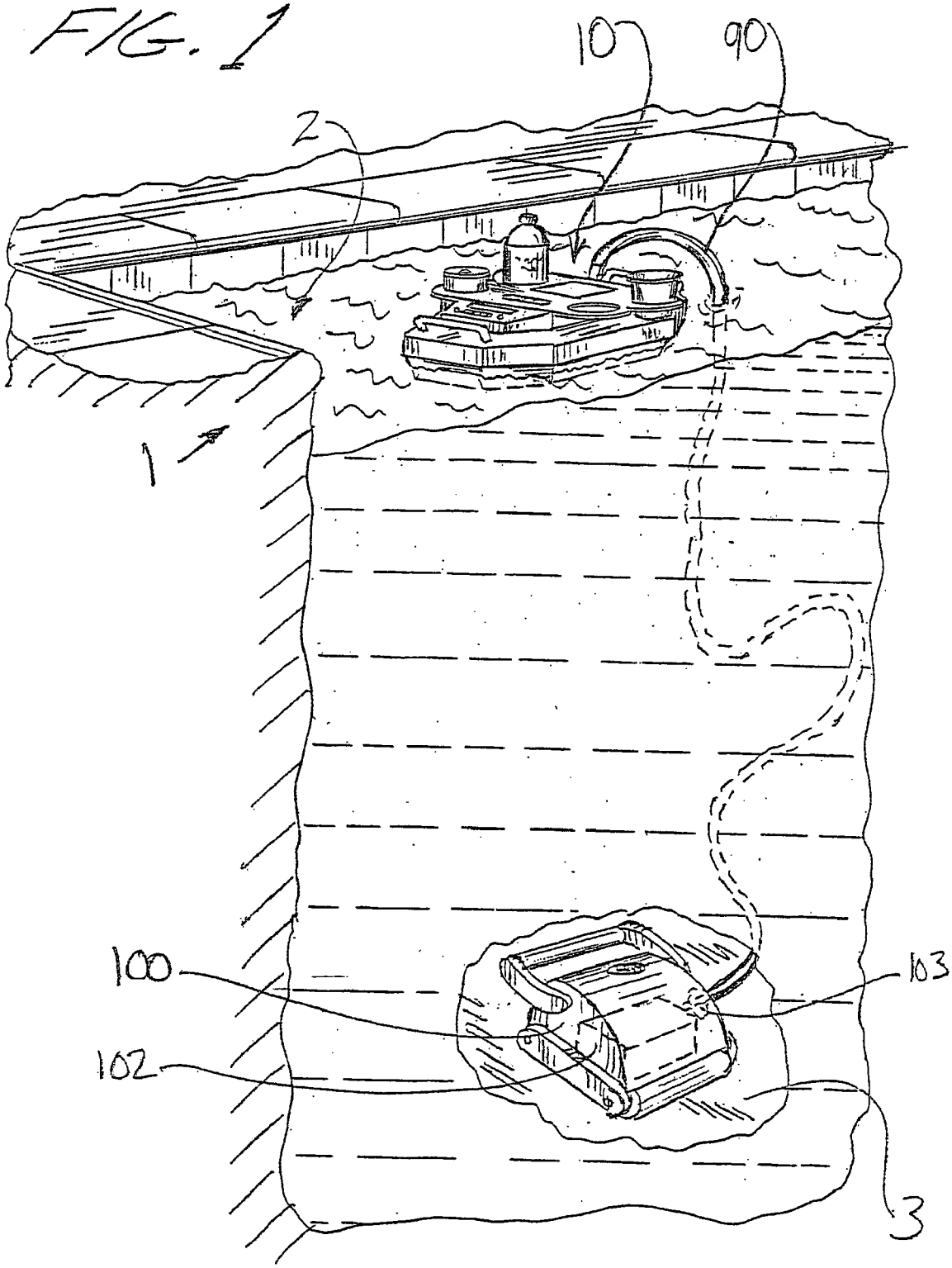
FIG. 1 is a perspective and partially cut-away view of one embodiment of the floating electronic platform of the invention in use in a swimming pool.

Referring now to FIG. 1, there is shown a schematic illustration of a portion of a swimming pool 1 with one preferred embodiment of an electronic platform 10 floating on the surface 2 of the pool. As will be described in more detail below, the electric power for platform 10 is supplied through a connecting power cable 90 that is attached to a robotic pool cleaner 100 that is positioned at the bottom surface 3 of the pool. The robotic cleaner 100 is powered by a rechargeable battery 102 that has a power input/output connector 103 on its exterior surface that is adapted to receive a mating connector on the end of cable 90.

Figure 2:
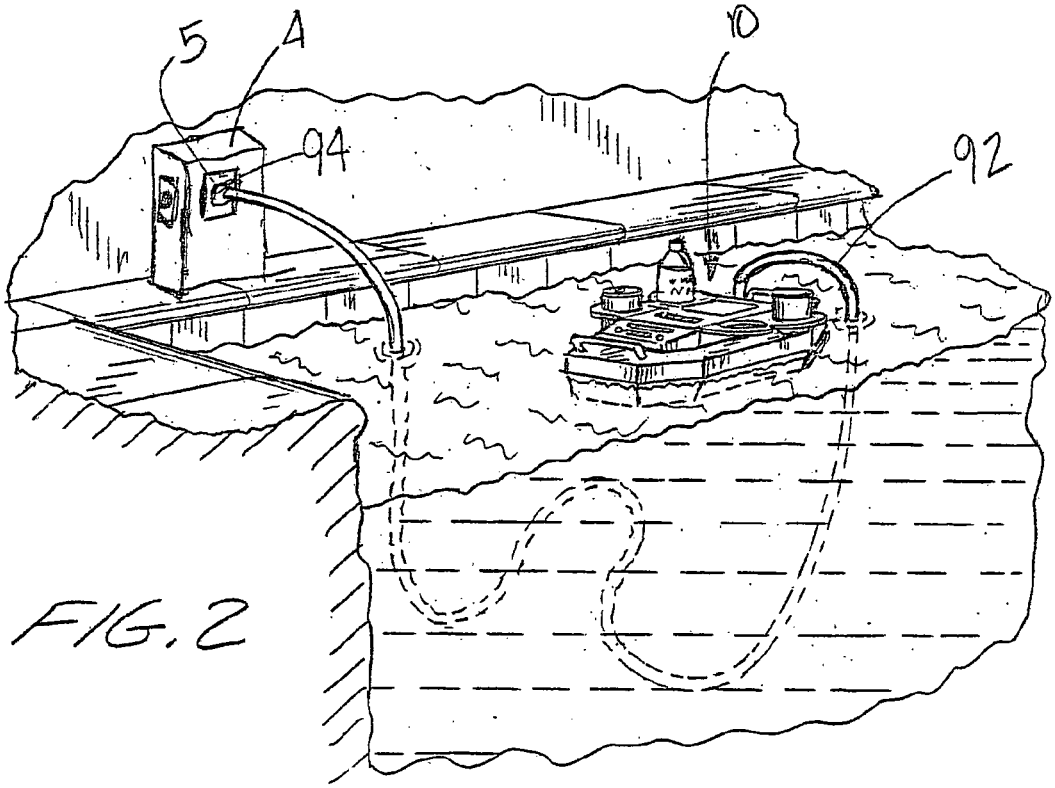
FIG. 2 is a view similar to FIG. 1 showing another manner of using the platform.
Figure 3:
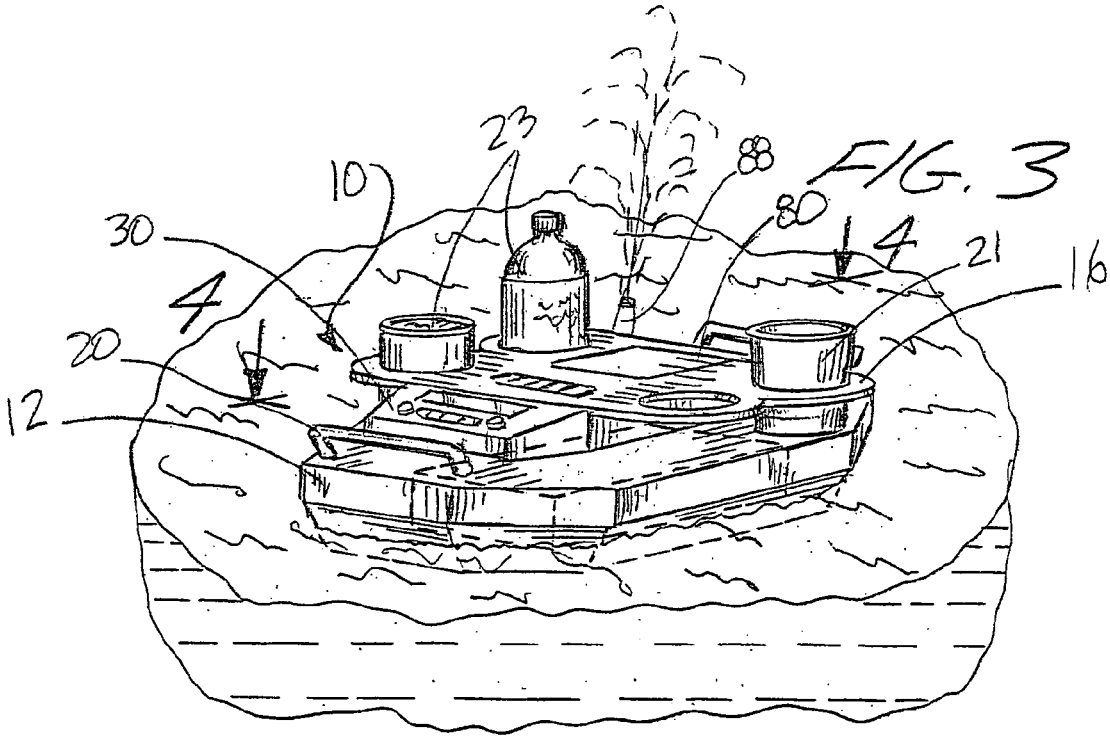
FIG. 3 is a top front right side enlarged view of the floating electronic platform of FIG. 1.
Figure 4:
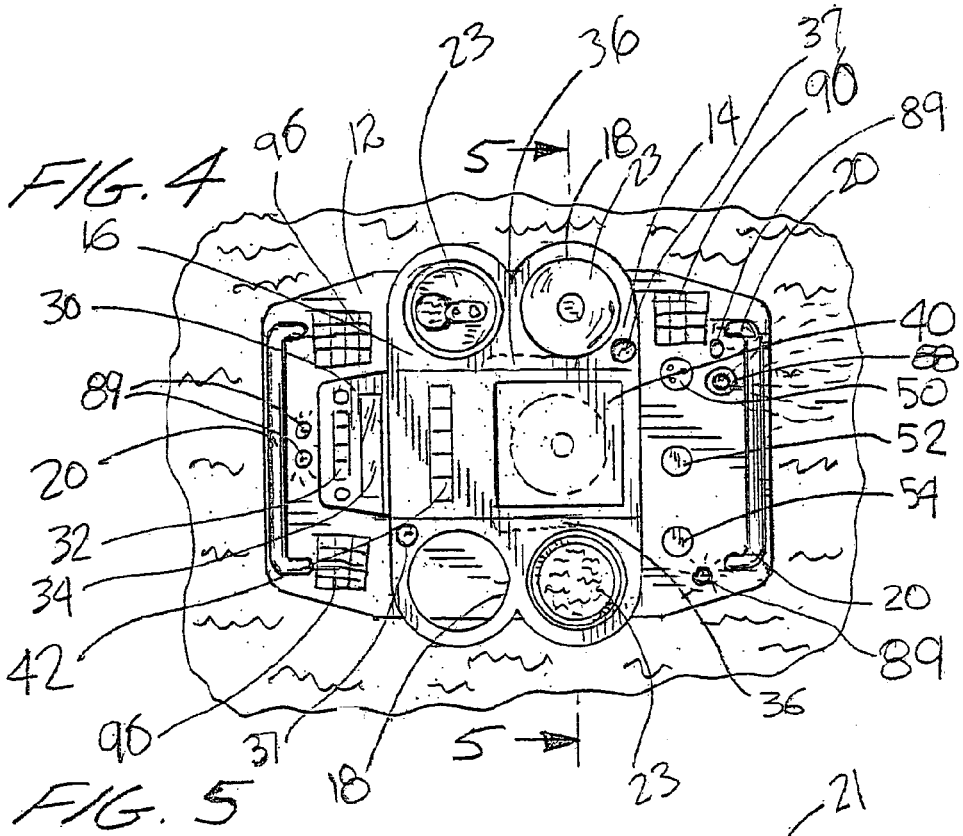
FIG. 4 is a top plan view of the platform in the direction of the arrows 4—4 of FIG. 3.
Figure 5:
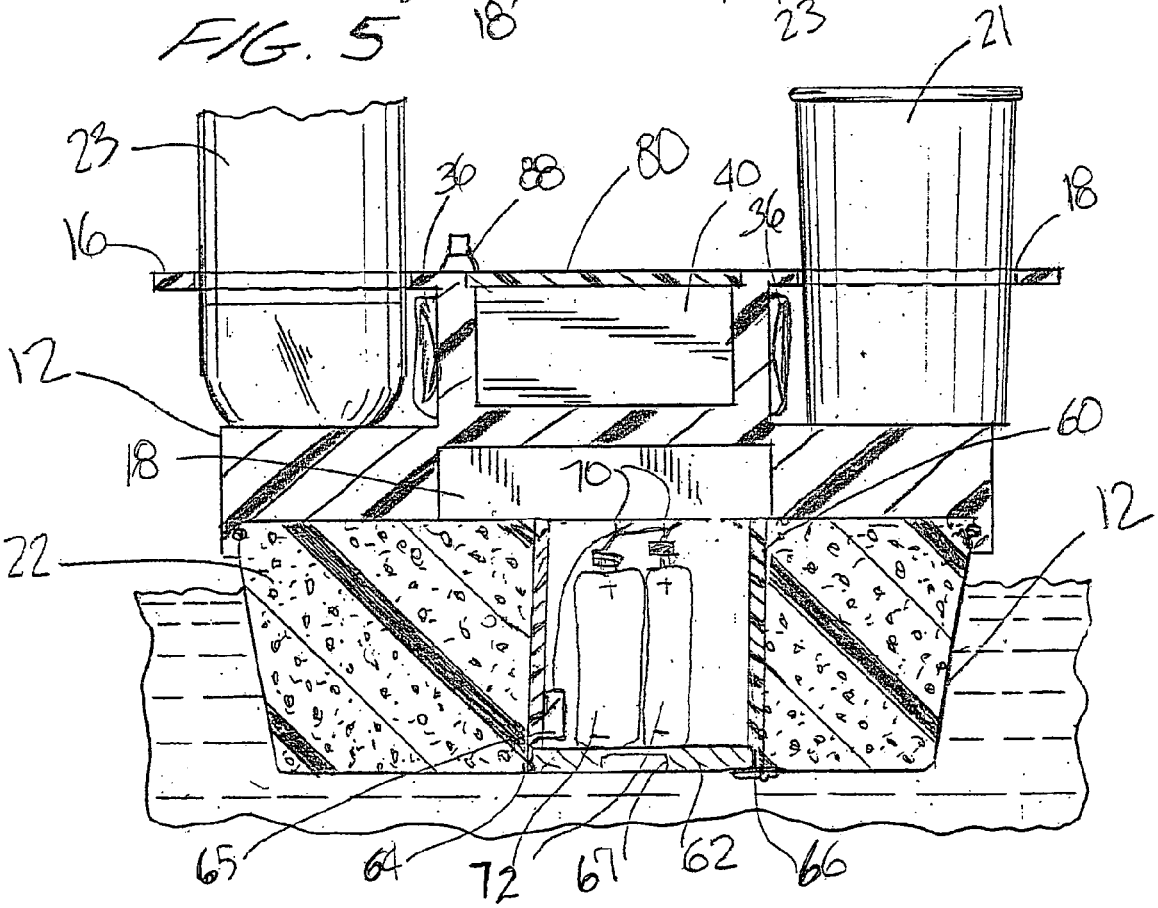
FIG. 5 is a cross-sectional view taken along lines 5—5 of FIG. 4.

In one preferred embodiment, as illustrated in FIGS. 1–5, the floating electronic platform is set up for use as an in-pool entertainment center that is equipped with one or more electrically-powered audio devices. In the embodiment schematically illustrated in FIG. 2, the power to floating platform 10 is provided by a cable 92 having a plug 94 that connects to a mating socket 5 in a conventional remote low-voltage power supply unit 4 located adjacent the pool. The power cable 92 is preferably of positive buoyancy and can float on the surface of the pool in order to minimize the vertical weight component on floating platform 10. However, as shown in FIGS. 2 and 5, a cable having negative buoyancy can be accommodated by providing appropriate flotation in the interior of the body 12 of platform 10.

For a more detailed description of the particular embodiment illustrated, reference will be made to FIGS. 3, 4 and 5. An outer housing or shell 12, which in the configuration shown has a generally planar upper surface and a rectilinear lower portion, can be fabricated from molded plastic as a unitary construction or assembled from components. However, as was made clear from the summary description of the invention provided above, the base or housing 12 can assume any configuration, including highly fanciful and stylized exterior shapes, the only limitation being that the complete article be stable when floating on the water's surface. As will also be understood by one of ordinary skill in the art, the buoyancy and placement of ballast, if necessary, must take into account the weight and placement of beverage containers, electronic devices and other items that may be stored in the unit above the water line. For example, a video electronic unit can be accommodated and its weight and center of gravity should be positioned to maintain stability.

Secured to the body 12 is a retaining platform, generally referred to as 16 that is provided with a plurality of recesses or openings 18 to receive any of a variety of beverage containers 23, such as cans, bottles and cups 21.

The opposing ends of the particular platform illustrated includes a pair of handles 20 to facilitate the movement, placement, and the removal and carrying of the platform in and outside of the pool. As will be understood by one of ordinary skill in the art, the housing or base 12 can also be provided with integrally molded handles, either in the form of projecting grips or recessed openings. A floating lanyard or tow rope can also be affixed to the platform to facilitate its movement and retrieval from outside of the pool using any of the long-handled tools customarily utilized for pool maintenance.

With continuing reference to FIG. 4, it will be seen that this embodiment is provided with an audio unit 30 in the form of a radio having water-protected control elements 32 and display 34. As best seen in FIG. 5, a pair of waterproof speaker housings 36 are provided and connected both to the radio 30 and a CD player 40 located in a waterproof housing and covered by access panel 80. The platform can also be provided with one or more lights 37 that provide decorative and/or ambient illumination. The lights are preferably controlled by a photoelectric cell (not shown) to turn the lights on after dark and off in daylight.

In yet another preferred embodiment illustrated in FIGS. 3, 4 and 5 the floating electronic entertainment center is provided with a conventional water pump and motor (not shown) that is connected to the rechargeable batteries 70 and to one or more water fountain jets 88 that extend through the surface of body 12. Water from the pool is drawn through an intake, presented by the pump and discharged into the air.

In a particularly preferred embodiment, one or more light sources, such as LEDs 89 are positioned adjacent the fountain jets 88 to illuminate the water spout and spray as it emanates from the fountain tip. This aspect of the invention provides a decorative effect that can be appreciated in the daylight by operation of the one or more fountains, and that is particularly pleasing after dark when the emitted water is illuminated by one or more colored light sources. As will be apparent to one of ordinary skill in the art, if a plurality of lights are utilized, changing patterns of illumination can readily be effected.

With further reference to FIG. 5, the battery compartment 60 is located in the lower portion of base 12 and surrounded by flotation material 22. This particular positioning permits the batteries 72 to function as ballast to stabilize the platform 10. Waterproof battery storage compartment 60 is accessed by closure 62, which in the embodiment shown is joined to the housing 12 by hinges 64 and secured by one or more latches 66. The handle 67 permits the closure to be lifted to access the batteries for maintenance and/or replacement. Electrical conductors 70 are joined to conventional circuitry for powering the audio components 30 and 40.

In a preferred embodiment, the platform is also provided with a safety shut-off switch 65 that can be activated by the incursion of water in the battery compartment 60 and/or by a mercury position switch that responds to a capsize or a lesser displacement from horizontal.

Again referring to FIG. 4, one or more connector outlets 50, 52 and 54 are provided on a conveniently accessible surface of housing 12. In this preferred embodiment, a plurality of connectors are provided to give maximum flexibility to the powering and use of the floating platform as a source of power to one or more other battery-powered devices. For example, one type of power cable 90 will be required when the floating entertainment unit is tethered to a battery-powered pool cleaner as was described in connection with FIG. 1. A different cable may be used when the unit is to be powered from a poolside power supply or other low-voltage power source. Alternate connector configurations can be accommodated in the plurality of input/output connectors 50, 52 and 54.

In a further preferred embodiment that will be described generally and with reference to FIGS. 4 and 5, the floating platform can also be provided with one or more solar power collecting panels 96. These panels can be mounted on any convenient surface which will be exposed to sunlight when the floating electronic platform is in the pool. For example, as shown in FIG. 4, a plurality of solar collector panels 96 are mounted in the surface of housing 12 where they are exposed to the maximum degree of sunlight. Alternatively, the cover 80 of compartment 40, best shown in FIG. 5, can incorporate the solar panels. Appropriate wiring (not shown) extends from beneath the solar panels 96 through conventional circuitry to provide a charging current to rechargeable batteries 72.

In yet another preferred embodiment of the invention illustrated in FIGS. 6 and 7, the floating electronic platform 10 serves only to support on body 12 one or more solar energy collector panels 96 that provide a recharging current to an on-board battery pack 72 or to a remote battery 102 such as that contained in submerged pool cleaner 100 as illustrated in FIG. 1. In this embodiment, the floating electronic platform provides a source of recharging current during the entire time that the solar collector panels are exposed to sunlight.

In accordance with methods that are well established in the art, the panels 96 can be pivotally and adjustably mounted in order to receive the maximum amount of solar energy during various seasons. By mounting a plurality of independent adjustable solar panels on the floating platform as shown in FIG. 6 and adjusting their position for the optimum seasonal solar rays, the maximum energy will be produced regardless of the orientation of the floating platform as it may be moved by wind or other influences on the surface of the pool. This method of gathering solar energy to provide a recharging current for batteries will provide a particular advantage during the long daylight hours of summer and in those latitudes where the intensity and duration of the sunlight is greatest and the use of the pool and its accessories is essentially year-round.

Various mechanical and electro-mechanical means for adjustably positioning the solar panels are known to the prior art. As best shown in FIG. 7, panels 96 are attached to rotatable supports 99 and moved by gears 97 driven by servo motors 98. Alternatively, manually adjustable supports delaying on frictional attachment can be utilized.

When the floating electronic platform serves only to support a plurality of solar power collector panels for the purpose of providing a current to a remote rechargeable battery, the on-board circuitry can be limited to providing terminals extending from the solar panels to the underside of a power cable connector, e.g., connector 50. This will provide an efficient and low-cost apparatus for recharging the batteries of a self-propelled robotic pool cleaner, which cleaner is provided with the necessary circuitry to accept the current from the solar collectors 90.

In a further preferred embodiment, the necessary circuitry is incorporated into a modular unit that has connectors adapted to mate with conventional power cables known to the art. In yet a further preferred embodiment, a robotic pool cleaner is provided with the necessary on-board circuitry to permit recharging via the current collected by the solar panels and transmitted through cable 90, as shown in FIG. 1.

Further reference is made to FIG. 1 for the illustration of a pool cleaner 100 tethered to the floating electronic platform 10. In yet another preferred embodiment, the robotic pool cleaner 100 has no battery and receives its motive power from rechargeable batteries 72 located in the floating platform 10 via power cable 90. The power cable 90 can have a neutral or a positive buoyancy and the continuous tethering of the floating platform containing one or more solar panels does not impede the patterned movement of the self-propelled robotic pool cleaner during its submerged operations. Since the robotic cleaner has no battery, it is relatively lighter in weight than comparable cleaners that are provided with on-board rechargeable batteries, and therefore more easily transported for storage and maintenance outside the pool.

As will be understood from the above descriptions of the several preferred embodiments, various modifications and additions can be incorporated into a floating electronic platform that will be within the skill of the art. The scope of the invention is therefore to be determined with reference to the claims which follow.

I claim:

1. A stable, manually portable floating electronic platform for use in swimming pools and spas, the platform comprising:

a buoyant housing having an upper surface that is configured with recesses for receiving one or more articles of predetermined shape and dimensions;

a power source selected from the group consisting of (i) one or more rechargeable on-board batteries, (ii) a power input plug, and (iii) a power input jack, where the plug and jack are configured to receive the end of a power cable connected to a source of electrical power remote from the platform;

one or more water-resistant electronic devices that are electrically connected to the power source; and a submerged self-propelled robotic pool cleaner electrically coupled to the buoyant housing, wherein the submerged self-propelled robotic pool cleaner provides power to the platform.

2. The floating platform of claim 1, wherein the electronic devices are selected from the group consisting of audio and visual entertainment communication devices, and solar power collector panels.

3. The platform of claim 2, wherein the entertainment devices are selected from the group consisting of lights, radios, tape and CD players, televisions, DVD players, speakers, water fountains, and combinations thereof.

4. The floating platform of claim 1, wherein the electronic devices are removably contained in one or more water-protected compartments.

5. The platform of claim 1, wherein the power source includes one or more rechargeable batteries.

6. The electronic platform of claim 1, wherein the surface recesses include retainers for cups and beverage containers.

7. The electronic platform of claim 1, wherein one or more of the recesses includes a watertight manually-releasable closure.

8. The platform of claim 1 which further comprises at least one handle for manually lifting the platform.

9. The platform of claim 8 which includes a pair of handles disposed at opposite ends of the platform and projecting from the surface.

10. The platform of claim 1 wherein the housing comprises a molded polymer.

11. The platform of claim 1 which further comprises a buoyancy controlled material positioned proximate the housing.

12. The platform of claim 1 which further comprises ballast positioned proximate the housing.

13. The manually portable floating electronic platform of claim 1, wherein the submerged self-propelled robotic pool cleaner receives motive power from the platform.

14. The platform of claim 1 further comprising a remote power source and a power cable connected to the remote power source.

15. The platform of claim 14, wherein the remote power source is selected from the group consisting of one or more rechargeable batteries and a low-voltage power supply unit.

16. The platform of claim 2, wherein the electronic device is one or more solar panels and the platform further comprises circuitry for conducting a recharging current to the power source.

17. The platform of claim 16, wherein the collection surfaces of the solar panels are oriented in different directions.

18. The platform of claim 16, wherein the solar panels are adjustably positioned on a surface of the housing.

19. The platform of claim 1 which further comprises a photocell switch in a circuit with the lights, whereby the lights receive power after dark.

20. The manually portable floating electronic platform of claim 1, wherein a connector is positioned on the surface of the housing for providing power in a waterborne environment to a remotely located electronic device.

* * * * *